US005529722A

United States Patent [19]

Aouad et al.

[11] Patent Number: 5,529,722

[45] Date of Patent: Jun. 25, 1996

[54] HIGH ACTIVE DETERGENT PASTES

[75] Inventors: Yousef G. Aouad, Brussels; Jose L. Vega, Strombeek-Bever; Paul I. A. Van Dijk, Putte, all of Belgium

[73] Assignee: The Procter & Gamble Company, Cincinnati, Ohio

[21] Appl. No.: 295,858

[22] PCT Filed: Mar. 1, 1993

[86] PCT No.: PCT/US/0001790

§ 371 Date: Sep. 7, 1994

§ 102(e) Date: Sep. 7, 1994

[87] PCT Pub. No.: WO93/18123

PCT Pub. Date: Sep. 16, 1993

[30] Foreign Application Priority Data

Mar. 10, 1992 [EP] European Pat. Off. ..... 92870040

[51] Int. Cl.$^6$ ..... C11D 3/065

[52] U.S. Cl. ..... 252/550; 252/551; 252/558; 252/121; 252/DIG. 14

[58] Field of Search ..... 252/549, 550, 252/551, 558, DIG. 14, 121, 108

[56] References Cited

U.S. PATENT DOCUMENTS

| | | | |
|---|---|---|---|
| 3,867,316 | 2/1975 | Frank et al. | 252/545 |
| 3,919,125 | 11/1975 | Ashina et al. | 252/551 |
| 4,384,978 | 5/1983 | Ploog et al. | 252/353 |
| 4,435,317 | 3/1984 | Gerritsen et al. | 252/547 |
| 4,487,710 | 12/1984 | Kaminsky | 252/546 |
| 4,692,271 | 9/1987 | Messenger et al. | 252/354 |
| 4,734,223 | 3/1988 | Winterbotham | 252/548 |
| 5,080,848 | 1/1992 | Strauss et al. | 264/117 |

*Primary Examiner*—Paul Lieberman
*Assistant Examiner*—Necholus Ogden
*Attorney, Agent, or Firm*—Ken K. Patel; Jacobus C. Rasser; Jerry J. Yetter

[57] ABSTRACT

A detergent paste composition comprising: from 50% to 94% by weight of an anionic surfactant; from 1% to 30% by weight of an alkyl ethoxy sulfate and from 5% to 35% by weight of water. The paste has a viscosity greater than 10 Pa.s at a temperature of 70° C. and measured at a shear rate of 25 $s^{-1}$. The paste has rheological properties making it well-suited to the further processing into high active detergent agglomerate suitable for use in free flowing granular detergent compositions.

11 Claims, 5 Drawing Sheets

HIGH ACTIVE DETERGENT PASTES

FIELD OF THE INVENTION

The present invention relates to pumpable high active surfactant pastes which are suitable for further processing into detergent granules, and to a process for making such pastes.

BACKGROUND OF THE INVENTION

Granular detergents have so far been principally prepared by spray drying. In the spray drying process the detergent components, such as surfactants and builders, are mixed with as much as 35–50% water to form a slurry. The slurry obtained is heated and spray dried, which is expensive. A good agglomeration process, however, could be less expensive.

There are many prior art nonspray-drying processes which produce detergent granules. Most require neutralisation of the anionic surfactant acid, immediately before, or in the course of, a granulation step.

However, these processes have certain limitations. The close coupling of the neutralization and granulation steps considerably limits the range of processing conditions that can be used. Furthermore, if the anionic surfactant chosen is not stable in the acid form (e.g. alkyl sulphate) it is necessary to have close coupling of the sulph(on)ation with the neutralization and granulation stages. This results in considerable limitations in the logistics and/or design of the facilities for these processes as well as an important increase in complexity and difficulty of control systems for the overall process.

The purpose of this invention is to provide a high active anionic surfactant paste which has rheological properties that make it suitable for pumping, storing, transportation between manufacturing sites, and further processing by agglomeration into high active detergent particles. It is an important feature of the invention that the granulation/agglomeration step is completely uncoupled from the sulph(on)ation step.

It has now been found that the addition of small amounts of alkyl ethoxy sulphate greatly improves the rheological characteristics of the surfactant paste.

GB2021141, published Nov. 28, 1979, discloses surfactant paste compositions within a narrow concentration range in the fluid lamellar ('G') phase.

GB2116200, published Sept. 21, 1983, discloses paste compositions of up to about 40% by weight of anionic surfactant containing ethoxylated surfactants as dissolution aids, and forming agglomerates from these compositions.

EP 403148, published Dec. 19, 1990, describes high active surfactant compositions containing less than 14% water. The use of process aids to reduce viscosity of the high active paste in a neutralisation loop is described. Polyethylene glycol and ethoxylated nonionic surfactants are disclosed as suitable process aids.

EP 399581, published Nov. 28, 1990, describes high active surfactant compositions containing ethoxylated anionic surfactants and ethoxylated nonionic surfactants.

SUMMARY OF THE INVENTION

The present invention relates to a detergent paste composition comprising: from 50% to 94% by weight of an anionic surfactant; from 1% to 30% by weight of an alkyl ethoxy sulphate and from 5% to 35% by weight of water. The paste has a viscosity greater than 10 Pa.s at a temperature of 70° C. and measured at a shear rate of 25 $s^{-1}$. The present invention also encompasses a process for making such a paste.

DETAILED DESCRIPTION OF THE INVENTION

The alkyl ethoxy sulphate herein has been found to act as a rheology modifier and gives the anionic surfactant paste the behaviour of a simple shear thinning fluid with a yield point. Accordingly the very concentrated paste of the present invention can be pumped with the certainty that it will not thicken during processing.

The Surfactant Paste

Typically surfactant pastes in the form of concentrated solutions can be described by non-Newtonian, shear thinning rheology models with yield points. These pastes usually show reduced viscosities at increased shear rates (see FIG. 1).

Surprisingly, it has now been found that under certain conditions of surfactant type, concentration, inorganic content, unsulph(on)ated contents, temperature etc., these pastes may show a rheology profile where, at certain shear rates, the viscosity increases with the shear rate. This phenomenon is referred to as shear thickening.

The presence of shear thickening in these pastes makes the transportation, storage and handling in general, a very difficult task. The possibility of the formation of these shear thickened pastes during pumping and conveying can result in considerable pressure drops and possible blockage of lines. In order to make the transportation of these pastes a robust operation, suitable for commercial application, it is necessary to ensure the absence of shear thickening behaviour and to turn the rheology of the paste into that of a typical shear thinning fluid, with or without a yield point.

This then makes it possible to completely decouple the neutralisation and granulation steps of making the finished detergent granule. The paste can be stored between these two steps, alternatively it can be transported between two manufacturing sites. This means that the manufacturing process is greatly simplified, and becomes much more flexible.

Physical Properties of the Paste

The paste has a high viscosity, greater than 10 Pa.s at 70° C. when measured at a shear rate of 25 $s^{-1}$, but has rheological characteristics that make it easily pumpable and favour further processing by agglomeration. Preferably the paste has a viscosity greater than 20 Pa.s at 70° C.

A process for making such a paste is also described hereinafter.

The paste is made up of two main components, the anionic surfactant (the "active" ingredient) and the alkyl ethoxy sulphate (the "rheological modifier"). These components are described in greater detail below.

The Anionic Surfactant

The aqueous surfactant paste contains an organic surfactant selected from the group of anionic surfactants, and mixtures thereof. Surfactants useful herein are listed in U.S. Pat. No. 3,664,961, Norris, issued May 23, 1972, and in U.S. Pat. No. 3,919,678, Laughlin et al., issued Dec. 30, 1975.

The paste includes a high concentration of anionic surfactant, 50%–94% by weight of the paste, preferably 60%–85%.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other useful anionic surfactants herein include the water-soluble salts of alpha-sulfonated fatty acid methyl esters containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used.

Particularly preferred surfactants for use herein include: sodium linear $C_{11}$–$C_{13}$ alkyl benzene sulphonate; a olefin sulphonates, triethanol ammonium $C_{11}$–$C_{13}$ alkyl benzene sulphonate; alkyl sulphates (tallow, coconut, palm, synthetic origins e.g. $C_{14}$–$C_{15}$ etc.) methyl ester sulphonate and the water soluble sodium and potassium salts of coconut and tallow fatty acids.

Most preferred are sodium $C_{11-13}$ linear alkyl benzene sulphonate, tallow alkyl sulphonate and mixtures thereof.

The Alkyl Ethoxy Sulphate

The rheology modifier in the paste is chosen from the alkali metal, alkaline earth metal, ammonium or substituted ammonium salts of alkyl ethylene oxide ether sulphates (generally referred to as alkyl ethoxy sulphates), containing from about 1 to about 7 units of ethylene oxide per molecule and wherein the alkyl group contains from about 10 to 18 carbon atoms. The alkyl ethoxy sulphate is present at a level of 1%–30% by weight of the paste, preferably 1%–15%.

Preferred are the sodium or potassium salts of alkyl ethoxy sulphate containing from about 2 to about 4 units of ethylene oxide.

Most preferred are products of the sulphation of synthetic, branched C13–C15, C14–C15 or C12–C15 ethoxylated alcohols with an average of about 3 units of ethylene oxide per molecule.

The ratio of anionic surfactant to alkyl ethoxy sulphate will vary according to the rheological behaviour of the anionic surfactant chosen. The ratio may vary between 2:1 (for example, in the case where the anionic surfactant is tallow alkyl sulphate), to 50:1 (for example, in the case where the anionic surfactant is a mixture of 75% LAS with 25% tallow alkyl sulphate). A preferred ratio of 9:1 is suitable in the case where the anionic surfactant is C14–C15 alkyl sulphate.

Water Content of the Paste

The water content of the paste is between 5% and 35% by weight. A low water content is preferable in order to be able to make high active detergent particles in the granulation/agglomeration step.

Optional Ingredients

Other ingredients commonly used in detergent compositions can be included in the paste of the present invention. These include additional surfactants, hydrotropes, suds boosters or suds suppressors, antitarnish and anticorrosion agents, soilsuspending agents, soil release agents, germicides, pH adjusting agents, enzyme stabilising agents, perfumes, polymers including polyacrylates, and copolymers including copolymers of maleic and acrylic acids.

Additional surfactants may be selected from the groups of anionic, zwitterionic, ampholytic, cationic and nonionic surfactants.

Suitable anionic surfactants include alkyl polyglucosides, alkyl glyceryl ethoxy sulphonates and alkyl glucose amides.

Suitable nonionic surfactants include the polyethylene oxide condensates of alkyl phenol, and water soluble condensation products of aliphatic alcohols containing from 8 to 22 carbon atoms, in either straight chain or branched configuration, with from 4 to 25 moles of ethylene oxide per mole of alcohol.

Semipolar nonionic surfactants including amine oxides, phosphine oxides, and sulphoxides are also suitable for use in the paste.

Ampholytic surfactants including those derived from secondary and tertiary amines, and zwitterionic surfactants including those derived from aliphatic quaternary ammonium, phosphonium and sulphonium compounds may also be used.

The Process

The surfactant paste is preferably produced in a continuous neutralisation system, for example a continuous neutralisation loop available from the Chemithon Corporation, Seattle, Wash., U.S.A. In a continuous neutralisation loop, organic sulphuric/sulphonic acid and concentrated metal hydroxide solution (greater than about 45% by weight of the hydroxide) are added to the loop where neutralisation takes place. For this invention, alkali metal hydroxide solution, between 50% and 75% hydroxide is preferred with the higher concentrations leading to less water in the final paste.

A separate stream of water may also be added to the loop, or mixed with the metal hydroxide in order to achieve the required water level in the finished paste.

The organic sulphuric/sulphonic acid for use in making the surfactant paste preferably is made by a sulph(on)ation process using $SO_3$ in a falling film reactor. See "Synthetic Detergents", $7^{th}$ Ed., A. S. Davidson and B. Milwidsky, John Wiley and Sons, Inc., 1987, pages 151–168.

The alkali metal hydroxide is preferably present in slight excess of stoichiometric amount necessary to neutralise the organic sulphuric/sulphonic acid. However, reserve (free) alkalinity should not exceed about 1.5% $M_2O$ (where M is metal)otherwise the paste becomes difficult to circulate because of high viscosity. If reserve alkalinity drops below about 0.1%, the surfactant paste may not be stable long term because of hydrolysis. It is therefore preferred that reserve alkalinity, which can be measured by titration with acid, of the paste in the neutralisation system be between about 0.1% and 1.5%, more preferably between 0.2% and 1.0%, most preferably between about 0.3% and 1.0%.

The organic sulphuric/sulphonic acid and alkali metal hydroxide are put into the continuous neutralisation loop, preferably at a high shear mixer in the neutralisation loop so that they mix together as rapidly as possible.

The alkyl ethoxy sulphate can be added at any suitable stage in the process, including post addition to the paste after the neutralisation loop or even in a storage tank, provided enough mechanical energy is provided to intimately mix the alkyl ethoxy sulphate with the salt of the anionic surfactant.

A preferred embodiment of the invention is to add the alkyl ethoxy sulphates directly into the neutralisation loop. In this way the rheology benefits of the invention are realised in the paste within the neutralisation loop and no additional mixing stage is required later.

Another alternative is to sulphate the ethoxylated alcohol at the same time as sulph(on)ation of the anionic surfactant. Then both components can be neutralised together in the neutralisation loop to give a paste of the required composition.

Further Processing of the Paste

The paste of the invention can be processed into high active detergent agglomerates by any conventional granulation/agglomeration step. This is normally done by agglomerating the paste upon mixing with a dry detergent powder.

A highly attractive option in a preferred embodiment of the present invention to further increase the concentration of surfactant in the final particle, is accomplished by the addition to a liquid stream containing the anionic surfactant and/or other surfactant, of other elements that result in increases in viscosity and/or melting point and/or decrease the stickiness of the paste. In a preferred embodiment of the process of the present invention the addition of these elements can be done in line as the paste is pumped into the agglomerator. Example of these elements can be various powders, including zeolite, carbonate, silica, silicate, citrate, phosphate, perborate etc. and process aids such a starch.

Powder Stream

Although the preferred embodiment of the process of the present invention involves introduction of the anionic surfactant in via pastes as described above, it is possible to have a certain amount via the powder stream, for example in the form of blown powder. In these embodiments, it is necessary that the stickiness and moisture of the powder stream be kept at low levels, thus preventing increased "loading" of the anionic surfactant and, thus, the production of agglomerates with too high of a concentration of surfactant. The liquid stream of a preferred agglomeration process can also be used to introduce other surfactants and/or polymers. This can be done by premixing the surfactant into one liquid stream or, alternatively by introducing various streams in the agglomerator. These two process embodiments may produce differences in the properties of the finished particles (dispensing, gelling, rate of dissolution, etc.), particularly, if mixed surfactants are allowed to form prior to particle formation. These differences can then be exploited to the advantage of the intended application for each preferred process.

It has also been observed that by using the presently described technology, it has been possible to incorporate higher levels of certain chemicals (e.g. nonionic, citric acid) in the final formula than via any other known processing route without detrimental effects to some key properties of the matrix (caking, compression, etc.).

The Agglomeration Step

The term "agglomeration," as used herein, means mixing and/or granulation of the above mixture in a fine dispersion mixer at a blade tip speed of from about 5 m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec.

Any apparatus, plants or units suitable for the processing of surfactants can be used for carrying out the process according to the invention. Suitable apparatus includes, for example, falling film sulphonating reactors, digestion tanks, esterification reactors, etc. For mixing/agglomeration any of a number of mixers/agglomerators can be used. In one preferred embodiment, the process of the invention is continuously carried out. Especially preferred are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention include Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series FM for batch mixing, series Baud KM for continuous mixing/agglomeration, manufactured by Lödige Maschinenbau GmbH, Paderborn Germany; Drais® T160 series, manufactured by Drais Werke GmbH, Mannheim Germany; and Winkworth® RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Operating Temperatures

Preferred operating temperatures should also be as low as possible since this leads to a higher surfactant concentration in the finished particle. Preferably the temperature during the agglomeration is less than 100° C., more preferably between 10° and 90° C., and most preferably between 20° and 80° C. Lower operating temperatures useful in the process of the present invention may be achieved by a variety of methods known in the art such as nitrogen cooling, cool water jacketing of the equipment, addition of solid $CO_2$, and the like; with a preferred method being solid $CO_2$, and the most preferred method being nitrogen cooling.

Final Agglomerate Composition

The present invention produces agglomerates of high density for use in detergent compositions. A preferred composition of the final agglomerate for incorporation into granular detergents has a high surfactant concentration. By increasing the concentration of surfactant, the particles/agglomerates made by the present invention are more suitable for a variety of different formulations. These high surfactants containing particle agglomerates require fewer finishing techniques to reach the final agglomerates, thus freeing up large amounts of processing aids (inorganic powders, etc.) that can be used in other processing steps of the overall detergent manufacturing process (spray drying, dusting off, etc.).

The agglomerates made according to the present invention are large, low dust and free flowing, and preferably have a bulk density of from about 0.4 to about 1.2 g/cc, more preferably from about 0.6 to about 0.8 g/cc. The weight average particle size of the particles of this invention are from about 200 to about 1000 microns. The preferred granules so formed have a particle size range of from 200 to 2000 microns. The more preferred granulation temperatures range from about 10° C. to about 60° C., and most preferably from about 20° C. to about 50° C.

Drying

The desired moisture content of the free flowing agglomerates of this invention can be adjusted to levels adequate for the intended application by drying in conventional powder drying equipment such as fluid bed dryers. If a hot air fluid bed dryer is used, care must be exercised to avoid degradation of heat sensitive components of the granules. It is also advantageous to have a cooling step prior to large scale storage. This step can also be done in a conventional fluid bed operated with cool air. The drying/cooling of the agglomerates can also be done in any other equipment suitable for powder drying such as rotary dryers, etc.

For detergent applications, the final moisture of the agglomerates needs to be maintained below levels at which the agglomerates can be stored and transported in bulk. The exact moisture level depends on the composition of the agglomerate but is typically achieved at levels of 1–8% free water (i.e. water not associated to any crystalline species in the agglomerate) and most typically at 2–4%.

Granular Detergent Compositions Containing the Agglomerates

The present invention also encompasses free flowing granular detergent compositions containing the agglomerates described hereinabove and processes to make them;

Said detergent compositions may comprise additional detergency builders and powders which may be added to the agglomerates to give a free flowing granular detergent composition. The additional detergency builder and powders may be combined into an aqeous slurry and spray dried to form a powder, and/or simply added to the agglomerates in a dry powder form.

In a preferred embodiment of the invention at least part of the builder is incorporated into a surfactant free slurry which has physical properties which make it suitable for spray drying by conventional process. A free flowing granular detergent composition is then made by mixing these spray dried particles, with the agglomerates of the invention and with any other detergency builders and powders.

Detergency Builders and Powders

Any compatible detergency builder or combination of builders or powder can be used in the process and compositions of the present invention.

The detergent compositions herein can contain crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

As mentioned above powders normally used in detergents such as zeolite, carbonate, silica, silicate, citrate, phosphate, perborate, etc. and process aids such as starch, can be used in preferred embodiments of the present invention.

EXAMPLES

1. In each of the following examples, the anionic surfactant paste was made by sulphation of a fatty alcohol followed by neutralisation by 48–50% aqueous solution of sodium hydroxide in a continuous neutralisation loop at production rates between 1 and 2 tonnes/hour.

Figure 1:
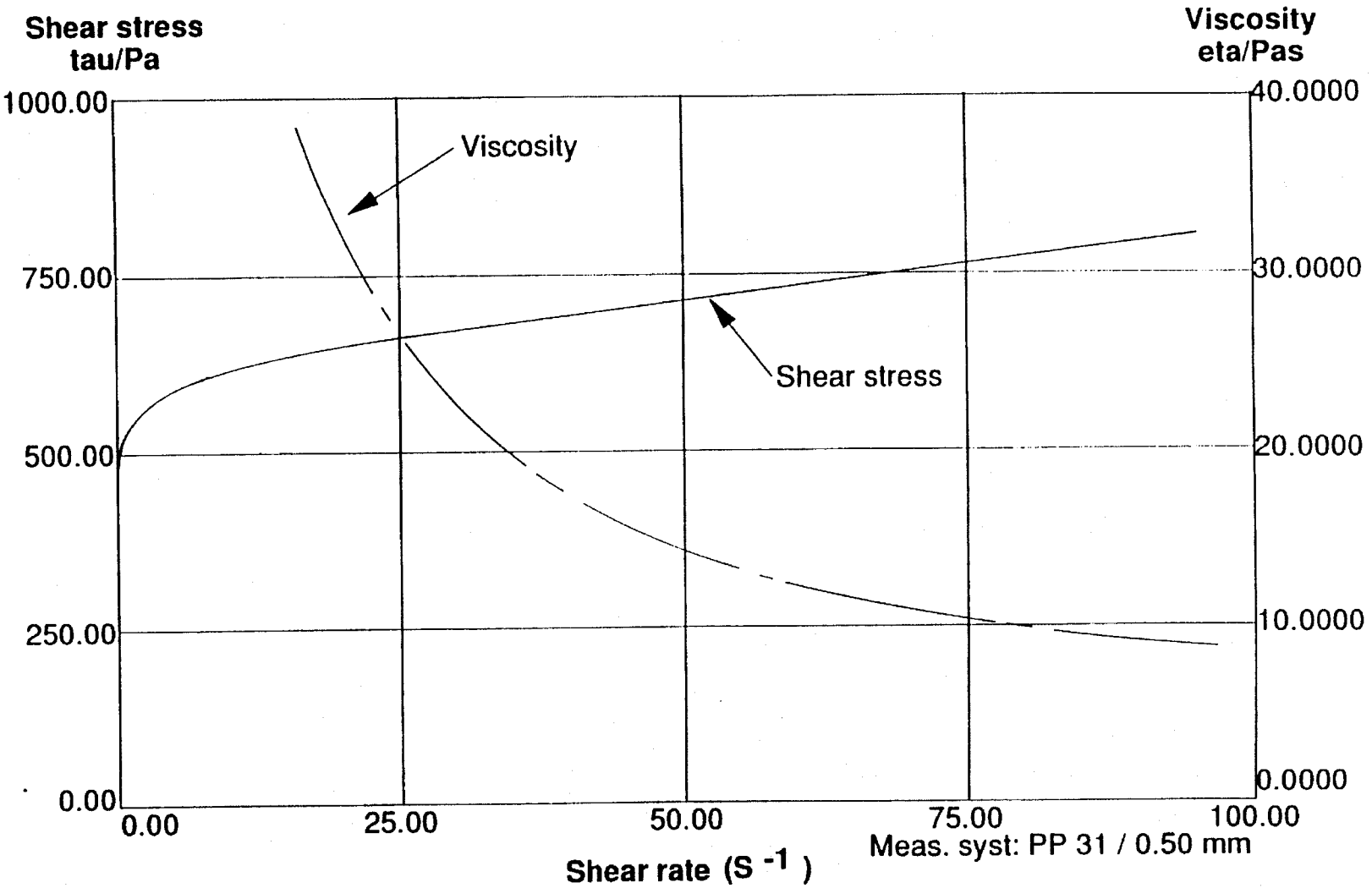
FIG. 1 shows graphs of shear stress and viscosity plotted against shear rate. The paste tested is 77% by weight sodium $C_{11}$–$C_{13}$ linear alkyl benzene sulphonate solution, measured at 70° C.
Figure 2:
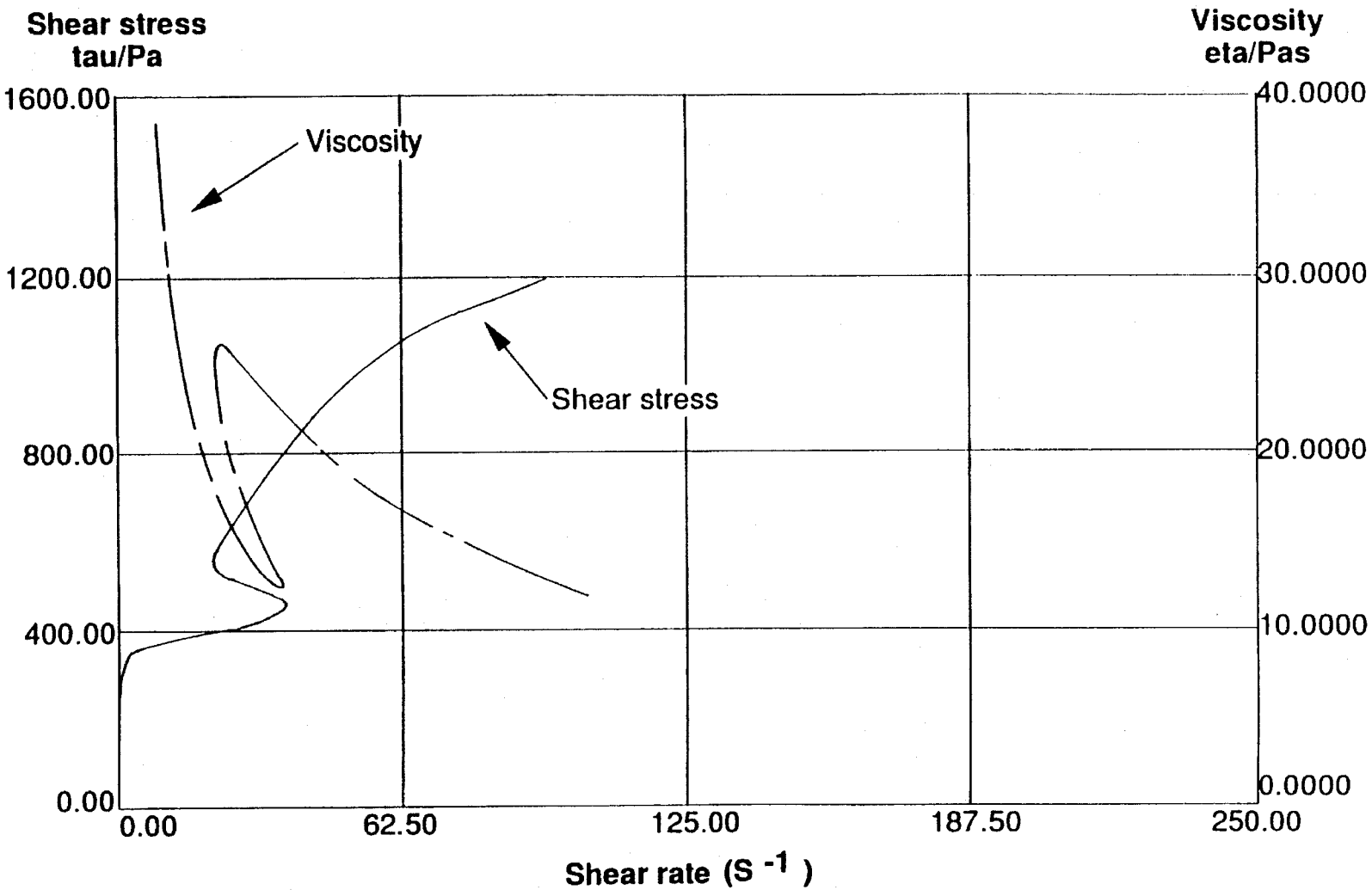
FIG. 2 shows graphs of shear stress and viscosity plotted against shear rate. The paste tested is 76% by weight sodium $C_{14}$–$C_{15}$ alkyl sulphate solution, measured at 70° C.

A 76% active paste of $C_{14}$–$C_{15}$ sodium alkyl sulphate has a rheological profile as shown in FIG. 2. There is a distinct shear thickening region at shear rates of between about 20 and 40 $s^{-1}$.

The following examples a–e illustrate how the rheological profile is modified by the addition of $C_{13}$–$C_{15}$ sodium alkyl ethoxy sulphate (with an average of 3 ethoxylate groups) In examples b–e the alkyl ethoxy sulphate is injected into the neutralisation loop.

| | a | b | c | d | e |
|---|---|---|---|---|---|
| Alkyl sulphate | 70 | 68 | 66.5 | 63 | 56 |
| Alkyl ethoxy sulphate | 0 | 2 | 3.5 | 7 | 14 |
| water(and misc.)* | 30 | 30 | 30 | 30 | 30 |

Figure 3:
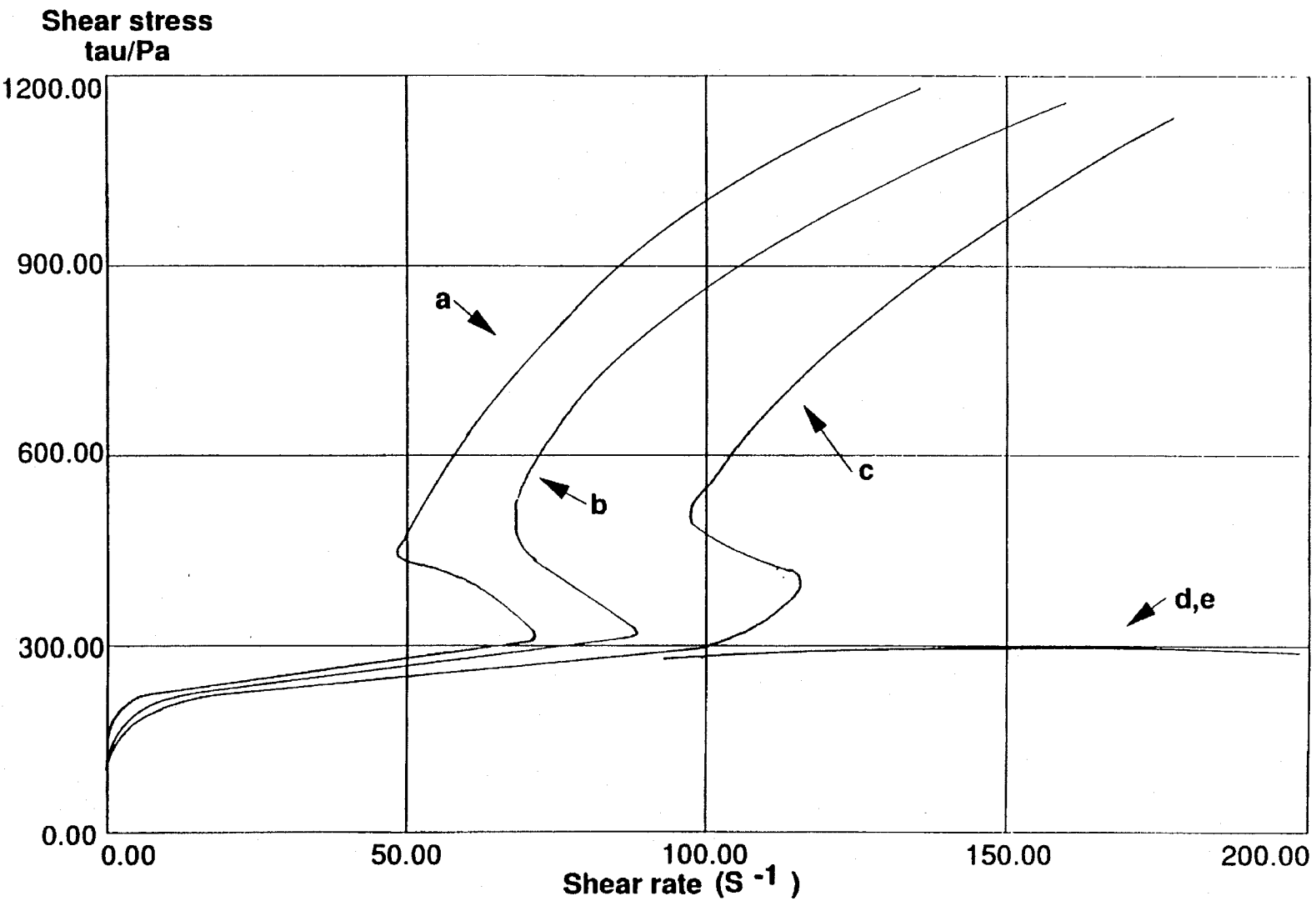
FIG. 3 shows graphs of shear stress plotted against rate for five different paste compositions. The percentage by weight of sodium $C_{14}$–$C_{15}$ alkyl sulphate solution: sodium C13–C15 alkyl ethoxy sulphate (with average of 3 ethoxylates) is a) 70:0, b) 68:2, c) 66.5:3.5, d) 63:7, e) 56:14. In each case the aqueous paste is measured at 70° C.

The shear thickening behaviour of compositions a–c can be seen in FIG. 3. By contrast, examples d and e do not show shear thickening behaviour, but rather they behave as shear thinning liquids (with a yield point).

2. In the following example a mixture of $C_{11}$–$C_{13}$ linear alkyl benzene sulphonate and tallow alkyl sulphate (equal parts of each by weight) was made by coneutralisation with a 48–50% aqueous solution of sodium hydroxide at a production rate of 1–2 tonnes/hour.

Figure 4:
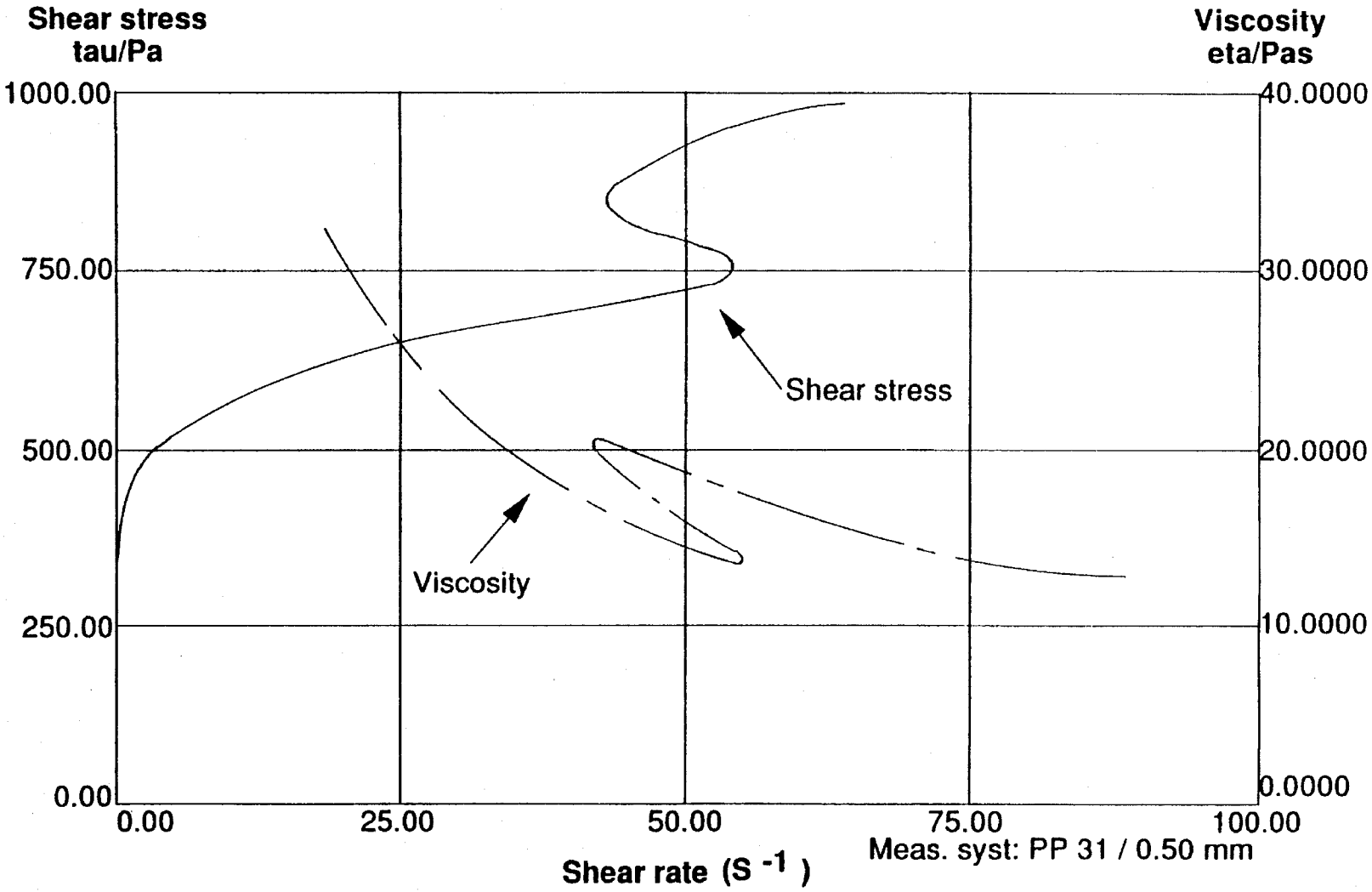
FIG. 4 shows graphs of shear stress and viscosity plotted against shear rate. The paste tested is 78% by weight of a mixture of sodium C11–C13 linear alkyl benzene sulphonate and sodium tallow alkyl sulphate. The two surfactants being present in equal proportions. The aqueous paste is measured at 70° C.
Figure 5:
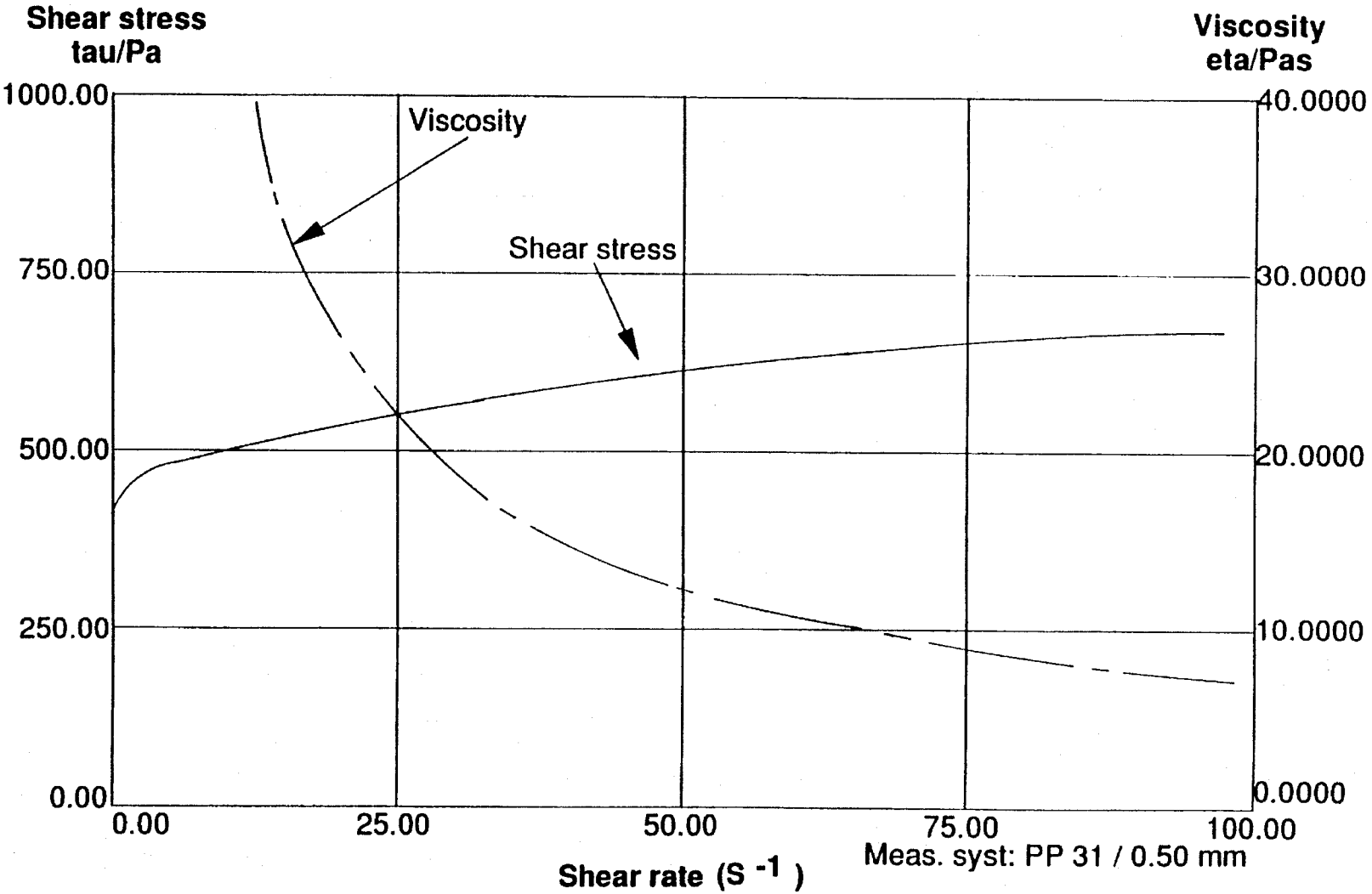
FIG. 5 shows graphs of shear stress and viscosity plotted against shear rate. The paste tested is 74.8% by weight of a mixture of sodium $C_{11}$–$C_{13}$ linear alkyl sulphonate and sodium tallow alkyl sulphate. The two surfactants being present in equal proportions. The paste also includes 3.2% by weight of sodium C13-15 alkyl ethoxy sulphate (with an average of 3 ethoxylates). The aqueous paste is measured at 70° C.

| | F (FIG. 4) | G (FIG. 5) |
|---|---|---|
| $C_{11}$–$C_{13}$ LAS | 39 | 37.1 |
| TAS | 39 | 37.4 |
| Alkyl ethoxy sulphate | 0 | 3.2 |
| water (and misc.)* | 22 | 22 |

The compositions in example F (see FIG. 4) behaves erratically in the neutralisation loop because of large pressure fluctuations caused by the rheological characteristics of this composition. This makes steady state production of this paste composition impossible by continuous neutralisation loop.

The composition in example G (see FIG. 5) contains 3.2% by weight of $C_{13}$–$C_{15}$ alkyl ethoxy sulphate (average of 3 ethoxylates) which makes the resulting paste composition behave as a shear thinning liquid.

Note: In examples 1 and 2 the total percentage reported for water also includes a low level of impurities, mainly unsulph(on)ated materials e.g. alcohols, fatty acids.

We claim:

1. A detergent paste composition consisting essentially of:

(a) from about 56% to about 63% by weight of a C12–C20 alkyl sulphate as an antionic surfactant;

(b) from about 7% to about 14% by weight of an alkyl ethoxy sulphate of the formula $R(OC_2H_4)_nOSO_3M$ wherein R is an aliphatic hydrocarbon group, branched or linear, containing from 10 to 18 carbon atoms, the average number of ethoxylate groups n is between 1 and 7, and M is an alkali metal, alkaline earth metal ammonium or substituted ammonium;

(c) from about 23% to 35% by weight water; and said paste not being shear thickening, having a viscosity greater than 10 Pa. s at a temperature of 70° C. and measured at a shear rate of 25 $s^{-1}$.

2. A detergent paste according to claim 1 wherein the alkyl ethoxy sulphate (b) is present at a level from 1% to 15% by weight of the composition.

3. A detergent paste according claim 1 wherein the viscosity of the paste is greater than 20 Pa.s at a temperature of 70° C. and measured at a shear rate of 25 $s^{-1}$.

4. A detergent paste according to claim 1 wherein the average number of ethoxylate groups, n, in the alkyl ethoxy sulphate (b) lies between 2 and 4.

5. A high active detergent agglomerate, containing 30%–80% by weight of the paste in claim 1.

6. A high active detergent agglomerate according to claim 5 comprising a dry detergent powder selected from zeolite, carbonate, silica, silicate, citrate, phosphate, perborate, starch and mixtures thereof.

7. A process for making a paste composition according to claim 1, including the continuous neutralisation of the anionic surfactant (a) in a neutralising loop, with an alkali metal, preferably sodium, hydroxide.

8. A process according to claim 7 wherein the alkyl ethoxy sulphate (b) is added after the neutralisation of the anionic surfactant (a).

9. A process according to claim 7 wherein the alkyl ethoxy sulphate (b) is added as a salt to the neutralisation loop during neutralisation of the anionic surfactant (a).

10. A process according to claim 7 wherein the anionic surfactant (a) and the alkyl ethoxy sulphate (b) are co-sulph(on)ated before neutralisation.

11. A process for making a free flowing granular detergent comprising the mixing of an effective amount of a detergent paste according to claim 1 and an effective amount of a dry detergency powder, rapidly forming a uniform mixture from said mix, granulating said mixture into discrete detergent agglomerates and admixing said detergent agglomerates with the remainder of the detergent composition.

* * * * *